United States Patent [19]

Burnbaum

[11] 4,154,431

[45] May 15, 1979

[54] MULTI-HINGED FENCE

[75] Inventor: Jack Burnbaum, Newton, Mass.

[73] Assignee: Bradford Novelty Co., Inc., Boston, Mass.

[21] Appl. No.: 791,800

[22] Filed: Apr. 28, 1977

[51] Int. Cl.[2] ..... E04H 17/00

[52] U.S. Cl. ..... 256/19; 256/22

[58] Field of Search ..... 256/19, 22, 25, 24

[56] References Cited

U.S. PATENT DOCUMENTS

| | | | |
|---|---|---|---|
| D. 188,112 | 6/1960 | Winograd et al. | 256/19 X |
| 1,985,322 | 12/1934 | La Clair | 256/22 |
| 2,295,271 | 9/1942 | Schuck | 256/22 |
| 2,574,711 | 11/1951 | Rose | 256/19 |
| 2,685,432 | 8/1954 | Murray, Jr. | 256/22 |
| 2,696,974 | 12/1954 | Gibbs | 256/19 |
| 2,962,263 | 11/1960 | Cofield | 256/22 |
| 3,111,303 | 11/1963 | Olson | 256/19 |
| 3,877,140 | 4/1975 | Topolsek | 256/19 X |

*Primary Examiner*—Andrew V. Kundrat

*Attorney, Agent, or Firm*—Kenway & Jenney

[57] ABSTRACT

A self-supporting fence of indefinite length is formed of a succession of fence units each having at least one vertically extending post member and at least one horizontally extending rail member integral with the post member. Continuous compliant strands extend horizontally through the rail member to flexibly link the units. The fence units are preferably formed of a high impact plastic and have a cored-out construction. The linking strands are preferably of braided fiber and embedded in each rail member. Some post members have downwardly projecting stake portions for supporting the fence.

9 Claims, 10 Drawing Figures

FIG. 1
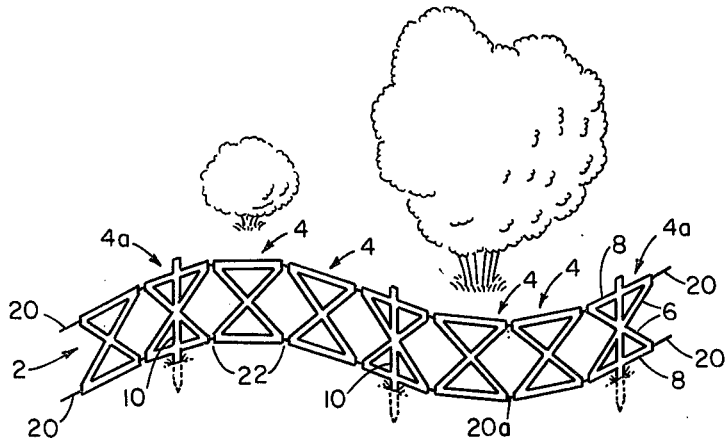
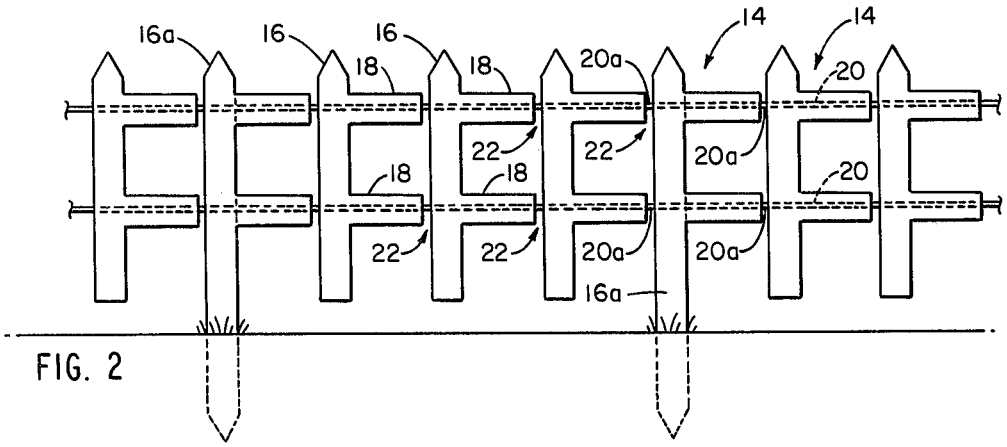
FIG. 2
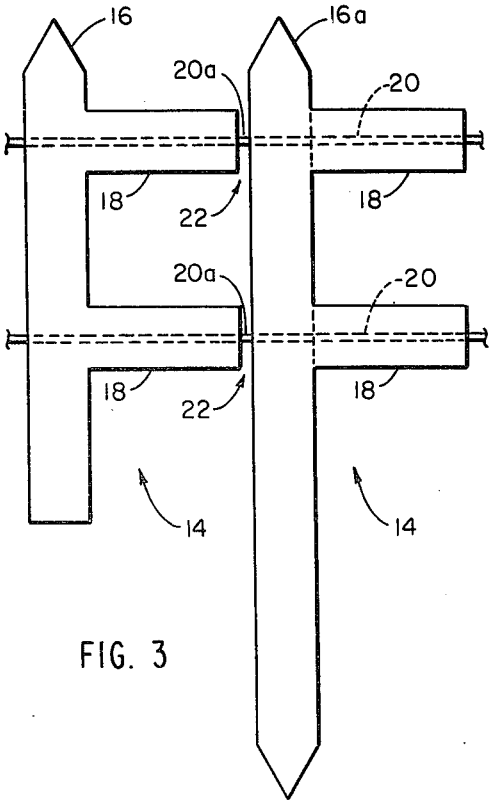
FIG. 3
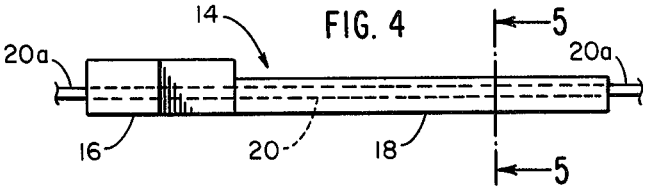
FIG. 4
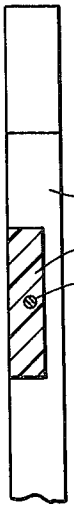
FIG. 5

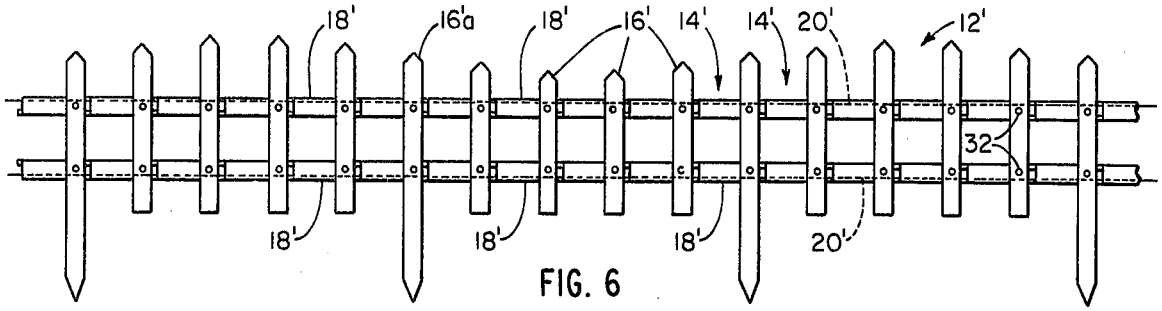
FIG. 6
FIG. 7
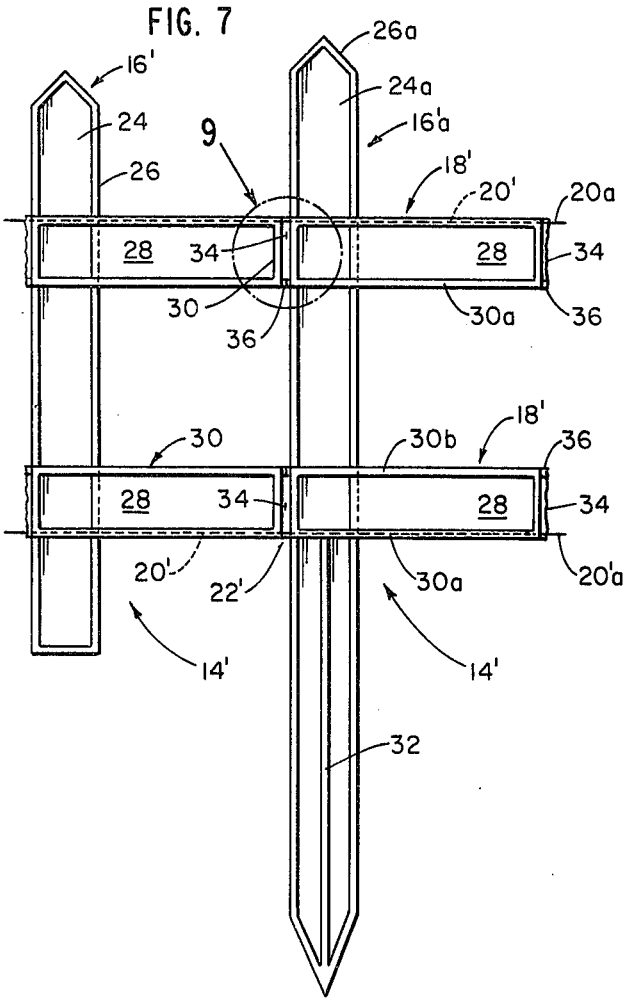
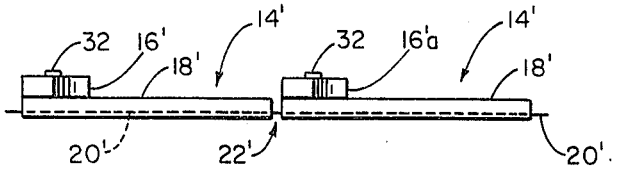
FIG. 8
FIG. 9
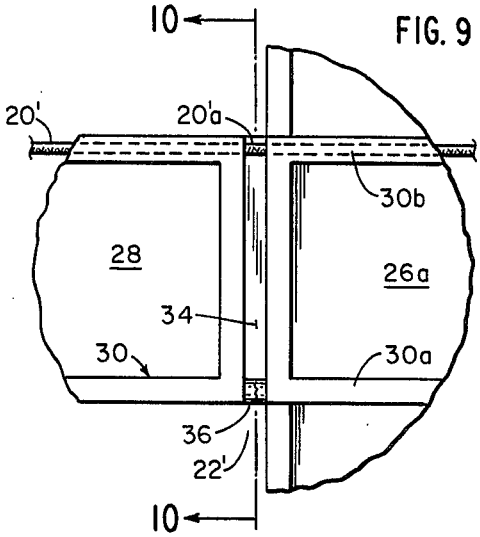
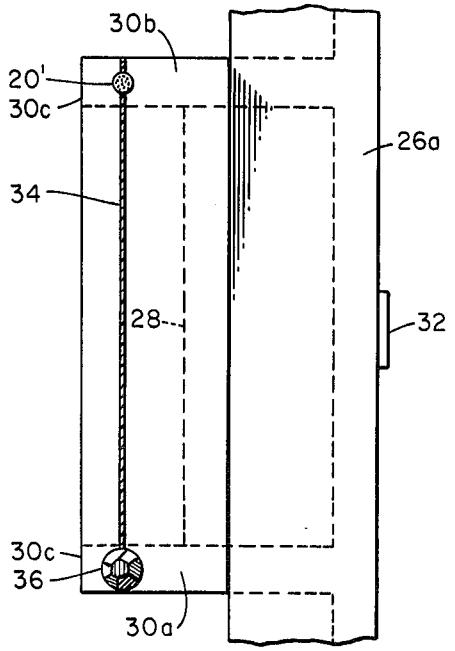
FIG. 10

MULTI-HINGED FENCE

BACKGROUND OF THE INVENTION

This invention relates generally to fences. More specifically, it provides fences—as of the garden border and like type—formed of a rigid plastic material and which are laterally flexible to follow a contour but yet are self-supporting and formed in indefinite lengths.

Fences are widely used in landscaping and gardening to protect and decorate shrubs, gardens, flower beds, trees and the like. Such a fence must be strong enough to withstand the mechanical stresses of handling, installation and relocation, particularly where it is supported by thrusting a projecting stake portion into the ground. The fence should also be laterally flexible to curve around trees and corners, or decorative contours of gardens and flower beds. It is also important for the fence to have an aesthetically pleasing appearance and to resist deterioration under adverse weather conditions.

Wooden picket fences that have a relatively short vertical height are a traditional form of shrub fence. The pickets are joined together either by wire strands or by wooden rails, typically in three foot lengths. Both forms of these wooden fences are relatively heavy and cumbersome, and require periodic maintenance. In addition, the wire links tend to rust and they fatigue after repeated flexing. The wooden rail sections, on the other hand, are inflexible and generally are available only in such short lengths.

U.S. Pat. Nos. 2,685,432; 2,696,974 and 2,962,263 describe metallic fences where flexibility is provided by a metal band that connects the vertical slats. While metallic fences have certain strength advantages as compared to wood fences, and can simulate the appearance of wood fences, they generally suffer from a higher cost of manufacture, they are generally heavier, and they require anti-corrosion protection and maintenance. Further, because these fences typically are formed of sheet metal to control cost and weight, they usually cannot be driven directly into the ground, but instead require auxiliary support stakes or posts.

Other metallic fences, which avoid these cost and weight problems, are formed of wire bent into segments, often in the general shape of inverted U's, that are hinged together. The lower ends of each section are pushed into the ground to support the fence. While these and other wire fences are fairly flexible and self-supporting, they are comparatively weak and have only a minimal visual impact. In particular, they do not offer the aesthetic and decorative advantages of traditional picket, scroll and other fence structures.

In recent years, plastic materials have been used for fences. U.S. Pat. No. 3,877,140, for example, describes a wire-connected snow fence having vertical slats of plastic sheet. The slats are interconnected by strands of wire that run horizontally through each slat, or by webs of the plastic sheet which forms the slats. One disadvantage of this fence is that the sheet material is so weak that each slat must be creased vertically to stiffen it, and the fence as a whole must be supported by other structure. Other disadvantages are that the wire is prone to rust and metal fatigue, and is likely to separate from the thin plastic.

Plastic shrub fences presently on the market generally fall into two categories, flexible fences of polyethylene and rigid fence sections of polystyrene. The polyethylene fences sacrifice strength for flexibility and therefore, under normal conditions, require auxiliary supports. Also the polyethylene material frequently softens and the colors fade when exposed to sunlight. The polystyrene fence sections, typically sold in three-foot lengths and designed to simulate wrought iron, are sufficiently rigid to be driven directly into the ground for support. But like the wooden sectional fences, they are inflexible and therefore ill-suited to many landscaping situations.

It is therefore a principal object of this invention to provide a plastic fence that is rigid, strong and self-supporting while at the same time is highly laterally flexible and capable of being formed in indefinite lengths.

Another object of this invention is to provide a structure for a plastic fence having the foregoing advantages and suited for attractively simulating different traditional fence designs.

Yet another object of the invention is to provide a fence of the above character and which does not deterioriate due to exposure to weather and requires minimal maintenance.

A further object of this invention is to provide such a fence that is lightweight and convenient to ship, store and install.

Still another object is to provide a fence with the foregoing advantages that is adapted to high volume, low-cost production techniques. A corollary object is to provide such a production method for a fence of the foregoing character.

SUMMARY OF THE INVENTION

A plastic, multi-hinged fence of indefinite length is formed from a succession of fence units each having vertically extending post member and at least one and preferably two horizontally extending, vertically spaced rail members. The post and rail members of each unit are preferably integral and of a high impact polystyrene. At least two continuous, vertically spaced strands are secured to the rail members and span gaps between adjacent units to form flexible hinges or links between them. A preferred strand is braided nylon embedded in the rail member.

In one preferred form, the post and rail members simulate a wooden picket fence, but yet have a cored-out construction. Selected posts have pointed lower ends that project below the ends of adjacent posts to form supporting stakes.

These and other objects and features of the invention will become apparent to those skilled in the art from the following detailed description which should be read in conjunction with the accompanying drawings.

BRIEF DESCRIPTION OF THE DRAWINGS

FIG. 1 is a view in perspective of a flexible plastic picket fence according to the invention;

FIG. 2 is a view in front elevation of another embodiment of a fence according to the invention;

FIG. 3 is an enlarged view of two units of the fence shown in FIG. 2;

FIG. 4 is an enlarged top plan view of one section of the fence shown in FIGS. 2 and 3;

FIG. 5 is a view in vertical section taken along line 5—5 in FIG. 4;

FIG. 6 is a view in front elevation of a preferred embodiment of the invention;

FIG. 7 is an enlarged view in rear elevation of two units of the fence shown in FIG. 6;

FIG. 8 is a top plan view corresponding to FIG. 7;

FIG. 9 is a detailed view of the linkage shown in FIG. 7; and

FIG. 10 is a view in vertical section along line 10—10 in FIG. 9.

DETAILED DESCRIPTION OF THE ILLUSTRATED EMBODIMENTS

FIG. 1 shows a fence 2 according to the invention implanted in the ground and curved around several shrubs. The fence 2 has a succession of side by side fence units 4 and 4*a* formed of a pair of crossed post members 6, 6 that extend generally in a vertical direction and a pair of horizontally extending rail members 8, 8. The rail members 8, 8 are vertically spaced and aligned with the rail members of the next fence unit. The post and rail members of each unit are formed integrally. Selected fence units 4*a* have support post members 10, each of which is also formed integrally with the members 6, 6 and 8, 8 of the associated unit. The support post 10 extends below the lower rail members 8 and has a tapered lower end that can be inserted into the ground to support the fence.

The units 4 are spaced from one another by a gap 22. A pair of compliant, continuous strands 20, 20 extend laterally through the fence units and each is embedded in one rail member 8. The portions of the strands 20, 20 that span vertically spaced and vertically aligned portions 22*a*, 22*a* of the gap 22 adjacent the strands 20, 20 form flexible links 20*a*, 20*a* that allow the fence to bend laterally. The fence units 4 are preferably formed of a high impact plastic and the strands 20, 20 are preferably formed of a braided synthetic fiber such as nylon.

The remaining FIGS. 2–10 illustrate in detail the construction of a different style fence according to the invention, namely, a picket fence. With particular reference to FIGS. 2–5, a fence 12 consists essentially of a side-by-side succession of spaced apart fence units 14 arranged with vertical posts 16 of one fence unit adjacent a horizontally extending, vertically spaced pair of rails 18, 18 of the next fence unit. Each illustrated unit 14 is substantially identical, and the rails of each unit are generally aligned with the rails of the other units. The units 14 are connected to one another by flexible links 20*a*, 20*a* provided by two parallel, continuous strands 20, 20. Each link 20*a*, 20*a* bridges the gap 22 between adjacent units. In the illustrated arrangement, each gap extends from the free-standing end of one rail to the post of the adjacent unit.

The illustrated posts 16 are pointed at their upper ends and the post 16*a* of certain units, every fourth unit in serial order shown, is pointed at its lower end to facilitate the insertion of the post 16*a* into the ground to support the fence. These support posts 16*a* extend below the other posts 16 so that the lower edges of the latter posts 16 are spaced from the ground when the support posts 16*a* are implanted to secure the fence. The length and the width of the posts can vary over a wide range, usually determined at least in part by aesthetic considerations. The posts have a substantial thickness, as best seen in FIGS. 4 and 5, to provide sufficient rigidity and strength to withstand the sizable torsional and bending forces generated by forcing them into the ground, particularly hard, dry ground.

The rails 18, 18 are formed integrally with an associated post 16 or 16*a*, but preferably have less thickness. As with the posts, the length and the width of the rails are determined to a large degree by aesthetic considerations. The width of the rails, however, should be sufficient to reliably surround and secure the strands 20. It will be understood that portions of the strands 20, 20 may not be completely embedded by the plastic material forming the rails due to unpredictable variations of the location of the strand within a mold that forms the fence units.

Another dimensional consideration is that the rails of each unit be short enough to facilitate coiling of the fence for shipment, storage and sale. The width of the gap 22 and the thickness of the rails affect the degree to which the fence flexes laterally, and therefore its ability to be coiled. While increasing the gap provides greater flexibility, it also allows a greater degree of undesirable vertical flexing. The dimension of the gap is therefore a balance of these flexural considerations together with the overall appearance of the fence.

As discussed above, it is desired that the fence 12 have significant rigidity and torsional strength, and that it resist deterioration under normal outdoor use. In particular, the plastic material forming the fence units should not soften or color fade under strong and prolonged sunlight, and should be substantially maintenance free. In addition the material should also be injection moldable and comparatively lightweight. It has been found that a high impact plastic such as polystyrene meets these criteria with the construction which the invention provides.

The strands 20 must have strength, compliant flexibility, resistance to fatigue under repeated flexure, and ability to withstand the heat of the molten plastic forming the fence units (for high impact polystyrene, approximately 400° F.). In addition, the strand should bond securely to the plastic of the fence unit to resist breaking free of the plastic when stressed. It has been found that braided synthetic fiber, and preferably nylon, meets these criteria.

In the manufacture of the fence 12, the strands 20 are introduced into a mold (not shown) for at least one and preferably several successive fence units 14. The strands are positioned within the mold so that each lies within one rail 18 and the adjacent post portion. Upon molding of the fence units, the plastic material preferably completely embeds the strands. However, unintended variations in the location of the strand within the mold may place portions of the strands at the exterior surface of the rail or the post. To ensure that the strand does not protrude through the front of the fence, the strands 20 are preferably positioned in the mold slightly closer to the fence rear surface than the front surface. Because the preferred strands 20 are braided or otherwise provided with interstices, the molten plastic flows during the molding into the interstices to provide a strong mechanical anchorage of each strand to the plastic.

FIGS. 6–10 show a fence 12′ in a preferred form with parts of the fence identified with the reference numeral of corresponding elements in the fence 12 shown in FIGS. 2–5, except that they are primed. The posts 16′ and 16*a*′ and rails 18′, 18′ forming the fence units have a "cored-out" construction as opposed to the solid construction shown in FIGS. 2–5. Each post 16′ or 16*a*′ has a continuous, but comparatively thin web portion 24 and 24*a*, respectively, and at least an upper flange portion 26 or 26*a*, respectively, integral with the web portion. The illustrated construction has both upper and lower flange portions that, with the web portion, for each post as a channel of C-shaped cross-sections. The illustrated rails 18′, 18′ have web portions 28 and peripherally extending integral flange portions 30 in a like configuration. The illustrated web portions 24, 24*a* and 28 present a continuous surface when viewed from the front that simulates a traditional wooden picket fence. The flange portions 26, 26*a* and 30 provide the necessary mechanical strength and rigidity. This "cored-out" construction is light, strong, uses a minimum quantity of material, and during manufacture promotes fast and uniform cooling of the fence units 14' after they are molded.

As with the FIGS. 2–5 embodiment, the upper ends of the illustrated posts 16' and 16*a'* are pointed and each support post 16*a'* is elongated downwardly with a pointed stake portion. The support posts 16*a'* also have a reinforcing rib 32 (FIG. 7) extending vertically from the lower tip to the lower flange portion 30*a* of the associated lower rail 18'. The rib 32 extends laterally to and is integral with the web portion 24*a*. Transverse rail flange portions 30*a* and 30*b* (FIGS. 7, 9 and 10) also extend to and are integral with the post web portions 24 and 24*a* to provide a strong connection between the post and rails of each fence unit.

The cored-out fence 12' of FIGS. 6–10 also has decorative features including a cyclic "scalloped" variation in the height of the posts 16' and 16*a'* above the upper rail 18'. Also, thereare nail-simulating cylindrical projections 32 formed on the posts 16' and 16*a'* in vertical alignment with the raile 18', 18'. Another feature is an integrally molded thin flashing 34 of the plastic material which forms the fence units and which extends continuously across each gap 22'. Initial bending of the fence after it is manufactured usually fractures the flashing 34 so that it does not detract from lateral flexibility. The flashing, however, covers the gap 22' to give the fence a "solid" appearance. As used in this specification, the term "gap" therefore includes both an open spacingbetween successive fence units as well as the spacing bridged by thin, flexible and/or rupturable sheet material.

With further reference to FIGS. 6–10, the strands 20' are embedded in the horizontally extending flange portions 30*a* or 30*b* of the rails 18', 18' of each fence units. Locating the upper strand 20' in the upper flange portion 30*a* and the lower strand 20' in the lower flange portion 30*b* enhances resistance to vertical bending. The strands are preferably centered vertically within the flange portions, and set back from the back edge 30*c* (FIG. 10) to minimize the likelihood of the strands breaking away from the fence unit. As with the FIGS. 2–5 embodiment, the fence units 14' are preferably injection molded of high impact polystyrene and the strands 20' are preferably braided nylon. FIG. 10 shows that a small plastic stem 36 can bridge each gap 22' aligned with the wall portions 30*a* and 30*b* that do not carry a strand 20'. The stems 36 readily rupture when the fence is flexed laterally, but the abutting fragments serve to control the spacing between the fence units.

A significant advantage of this invention as compared to prior art rigid polystyrene fence sections is that the rigid sections were typically formed in three foot lengths which required a forty-inch mold, whereas the present fence with comparable dimensions can be continuously formed in, for example, a twenty-four inch mold. Several successive fence units can be molded about the strands 20' at the same time. The units are then advanced in step-wise fashion to form the following fence units about the following portions of the strands 20'. The manufacturing process is thus step-wise continuous. It hence is relatively fast, and utilizes a comparatively small, low cost mold. When the fence is formed and cooled, it can be coiled to make it relatively compact and convenient to handle, store and ship. Besides being able to manufacture the fence of this invention in any predetermined length, it is also possible to sell it "by-the-foot", from a large supply roll, by severing the linking strands at the gaps, so that a purchaser can buy only as much fences as needed.

In use, the fence is placed in the desired location and secured by thrusting the posts 16*a* or 16*a'* into the ground. Preferably a "starter" hole is formed with a screw driver or similar tool to facilitate inserting the support posts 16*a* or 16*a'* to the proper depth.

By way of illustration but not of limitation, one fence 12' has posts and rails with a width of seven-eighths inch and a thickness of one quarter inch, and each gap 22' extends horizontally one-sixteenth inch. The web and flange portions are about one-sixteenth inch thick and the flange portions project three-sixteenths inch above the rear surface of the adjoining web portions, except in the region where the rails and post overlie one another.

There has been described a plastic fence of the garden border type that is rigid and self-supporting, while at the same time highly flexible in the lateral direction. Because the fence is formed from a plastic, and preferably a high there are polystyrene with a cored-out construction, it is also lightweight, maintenance-free resistant to both softening and color fading by sunlight. In rails the plastic fence of this invention is convenient to store, handle and install and has a relatively low cost of manufacture. spacing between While the invention has been described with reference to specific fence styles, it will be understood that features of the invention can be used to form fences of different styles. It is also contemplated that fences utilizing this invention can be formed with one rail member having a sufficient height to provide vertical stability, or with three or more rail members. While the invention has been described with one strand embedded in each rail member, two or more strands can be embedded in each rail member. Further, while the rails have been described as extending to only one side of a post, it is within the scope of this invention to form fence units with rails that join a post at a central portion and have two free ends that align with similar free rail ends of adjacent fence units. It is also contemplated that each fence unit 12 or 12' can have more than one horizontally spaced, vertically extending post member. Such a fence, however, would have less lateral flexibility than a fence formed of smaller, one-post units. These and other modifications and variations will occur to those skilled in the art from the foregoing detailed description and the accompanying drawings. Such modifications and variations are intended to fall within the scope of the appended claims.

What is claimed and desired to be secured by Letters Patent is:

1. A self-supporting and laterally-flexible fence comprising a longitudinal succession of fence units, A. each pair of adjacent units defining between them at least first and second vertically-spaced gap portions, said first gap portions of at least plural fence units being horizontally aligned with one another, and said second gap portions of at least plural fence units being horizontally aligned with one another, each fence unit being of substantially rigid one-piece molded construction and having at least one substantially rigid fence member extending vertically and at least two substantially rigid fence members extending horizontally from one end only of said unit, said fence members of adjacent units defining said first and second gap portions between said units, and B. at least first and second flexible compliant strands, each of which extends longitudinally along plural fence units, each strand being embedded within members of each fence unit upon the molding thereof and spanning gap portions to secure said units together and provide said lateral flexibility.

2. A self-supporting fence of indefinite length having flexibly interconnected fence units comprising A. a succession of separate fence units having gap portions therebetween and each of which has a unitary structure of molded plastic material with at least a substantially rigid vertical post member integral with a pair of first and second vertically spaced and substantially rigid horizontally-extending elements, each said post member having a substantially planar web portion and at least first and second integrally formed flange portions extending generally perpendicular to said web portion and horizontally along the fence unit, said first elements of successive fence units being aligned with one another and said second elements of successive fence units being aligned with one another, and B. at least first and second continuous flexible strands interconnecting adjacent fence units, each strand extending between at least horizontally-extending elements and spanning said gap portions, said first and second strands being embedded in the plastic material of said fence units and respectively extending along and secured to said first and second flange portions of post members and to said aligned first elements and said aligned second elements.

3. A self-supporting fence of indefinite length having flexibly interconnected fence units comprising A. a succession of separate fence units having gap portions therebetween and each of which has a unitary structure of molded plastic material with at least a substantially rigid vertical post member integral with a pair of first and second vertically spaced and horizontally extending substantially rigid rail elements, said post member and rail elements each having a substantially planar web portion and an integrally formed flange portion extending at least longitudinally of said web portion and generally perpendicular to said web portion, and said first rail elements of successive fence units being aligned with one another and said second rail elements of successive fence units being aligned with one another, and B. at least first and second flexible link members interconnecting adjacent fence units, each link member extending from at least one rail element and spanning one said gap, said first link members and said second link members being formed by first and second continuous strand means embedded in the plastic material of said fence units and respectively extending along and secured to horizontally-extending flange portions of said aligned first rail elements and of said aligned second rail elements.

4. A self-supporting fence of indefinite length having flexibly interconnected fence units comprising A. a succession of fence units closely spaced apart by gaps and each of which has a unitary structure of molded plastic material with at least a substantially rigid vertical post member integral with a pair of first and second vertically spaced and substantially rigid horizontally-extending elements, said first elements of successive fence units being aligned with one another and said second elements of successive fence units being aligned with one another, B. at least first and second flexible link members interconnecting adjacent fence units, each link member extending from at least one said element and spanning one said gap, said first link members and said second link members being formed by first and second continuous strand means embedded in the plastic material of said fence units and respectively extending along and secured to said aligned first elements and said aligned second elements, and C. a flashing of said plastic material extending across each of at least a plurality of said gaps.

5. A fence according to claim 3 in which said rail flange portion adjacent said post extends to and is integral with said post web portion.

6. A self-supporting and laterally-flexible fence comprising a longitudinal succession of fence units, A. each pair of adjacent units forming between them at least first and second vertically-spaced gap portions, said first gap portions of at least plural fence units being horizontally aligned with one another, and said second gap portions of at least plural fence units being horizontally aligned with one another, each fence unit being of substantially rigid one-piece molded plastic construction and having at least one substantially rigid vertically-extending fence member integral with first and second substantially rigid means horizontally-extending from the same end of the unit assymetrically thereof, and B. at least first and second compliant fibrous strands, each of which extends longitudinally along plural fence units, each strand being embedded within the vertically-extending member and the horizontally-extending means of each fence unit upon the molding thereof and spanning successive units and gap portions to secure said units together and provide said lateral flexibility.

7. A fence according to claim 6 wherein said rigid plastic material is a high impact polystyrene.

8. A fence according to claim 6 wherein said strands are formed of braided nylon.

9. A fence according to claim 6 further comprising

A. a cored-out structure in said vertical fence members, and

B. first and second horizontally-extending portions spanning the cored-out structure of each vertical member and each of which embeds therein one said strand.

* * * * *